United States Patent [19]
Marchal et al.
[11] 4,317,588
[45] Mar. 2, 1982

[54] RAIN DEFLECTOR FOR DOOR

[75] Inventors: Claude Marchal, Seraing; Christian Van Espen, Nalinnes, both of Belgium

[73] Assignee: Caterpillar Tractor Co., Peoria, Ill.

[21] Appl. No.: 117,584

[22] Filed: Oct. 15, 1979

[51] Int. Cl.[3] ..... E05C 13/00
[52] U.S. Cl. ..... 292/341.14
[58] Field of Search ..... 292/198, 216, 341.14, 292/341.17, DIG. 41

[56] References Cited

U.S. PATENT DOCUMENTS 3,027,185 3/1962 Allen et al. ..... 292/280
3,240,524 3/1966 Priestman ..... 292/341.14
3,680,902 8/1972 Slattery ..... 292/341.14

*Primary Examiner*—Richard E. Moore
*Attorney, Agent, or Firm*—Wegner, Stellman, McCord, Wiles & Wood

[57] ABSTRACT

A door latch mechanism (15) having a rain deflector (17) for preventing passage of rain water and the like past the latch mechanism into the space (18) selectively closed by the door (13) carrying a portion of the latch mechanism. The deflector includes projections (32, 33) fitted into sockets (23, 24) of the frame (11) and includes a base wall portion (25) having a slot (34) embracing the strike (37) of the latch mechanism when installed therein. The deflector may be formed of synthetic resin at low cost and effectively hides the latch box mechanism for improved aesthetic effect.

11 Claims, 9 Drawing Figures

RAIN DEFLECTOR FOR DOOR

DESCRIPTION

1. Technical Field

This invention relates to latch mechanisms and in particular to door latch mechanisms for use in vehicles, such as tractors and the like.

2. Background Art

In vehicles, such as tractors and the like, the doors thereof are conventionally provided with sealing means for effectively sealing the door to the vehicle body about the opening being selectively closed by the door.

A problem arises in providing an effective seal in the area of the door latching mechanism where the body flange defining the door opening may be interrupted. Such interrupted configuration of the door flange presents a serious problem in such door assemblies such as used in tractors and the like which are subject to rigorous environmental conditions at times. Thus, rain water and the like may undesirably pass through the space between the door and the body frame in the area of the latch mechanism, presenting an undesirable condition within the operator cab.

DISCLOSURE OF INVENTION

The present invention comprehends an improved door latch mechanism assembly wherein a rain deflector element is provided which is readily installed to the means defining the door opening in the area of the latch mechanism and which serves to prevent passage of rain water and the like therepast so as to effectively avoid the problem of the prior art.

The present invention contemplates forming such a rain deflector as a one-piece element which may be readily installed in the existing structure of such vehicle door latch mechanisms.

The deflector may be formed of a synthetic resin and define a low cost structure which further may be mounted to the mechansim at effectively minimum cost.

More specifically, the invention contemplates providing in a door latch mechanism having a support defining a base wall, a strike projecting from said base wall, a first socket means at one end of the base wall, a second, opposed socket means at an opposite end of the base wall, a rain deflector having a base wall portion adapted to mount in facially overlying relationship to the support base wall, an inner transverse barrier wall portion for intercepting rain water and the like passing inwardly past the strike, and projection means at opposite end portions of the deflector for fitted engagement with the socket means to retain the deflector mounted to the support.

The invention further comprehends the provision of means for draining the collected intercepted rain water and the like. In the illustrated embodiment, the draining means comprises an opening in the bottom portion of the deflector leading to a drain passage provided in the door frame support means.

The deflector may include an inclined bottom wall portion for guiding the collected intercepted rain water and the like to the drain opening.

The rain deflector provides the further highly desirable feature of effectively hiding the strike and latch box mechanism of the door latch structure so as to provide improved aesthetic effect.

The rain deflector is arranged to be accommodated within the configuration of the existing door latch mechanism so as to leave unaffected the maneuverability of the door without requiring any structural changes in the door latch mechanism assembly.

Thus, the rain deflector of the present invention is extremely simple and economical of construction while yet providing the highly desirable features discussed above.

BEST MODE FOR CARRYING OUT THE INVENTION

Figure 1:
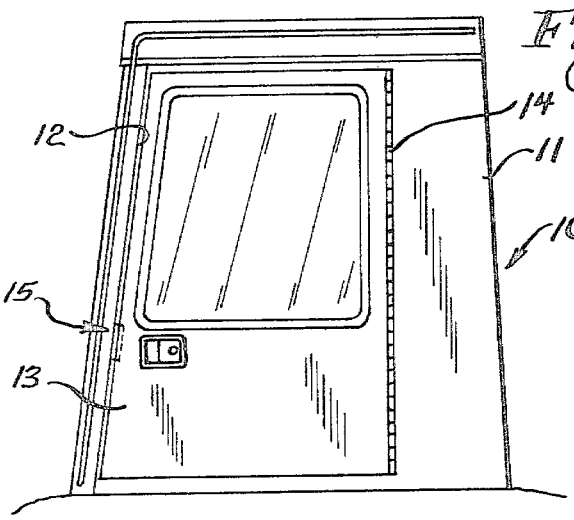
FIG. 1 is a side elevation of a tractor cab having a door provided with a door latch mechanism, including a rain deflector embodying the invention.
Figure 2:
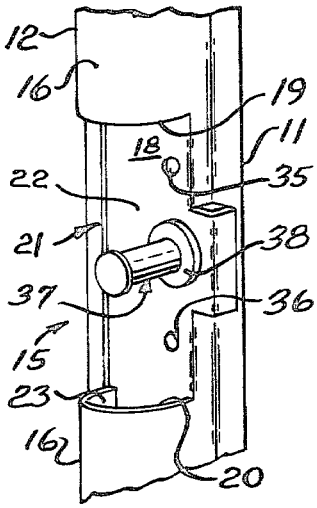
FIG. 2 is a fragmentary perspective view illustrating the area of the door strike structure.
Figure 3:
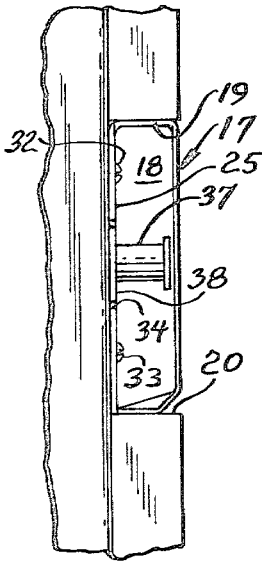
FIG. 3 is a fragmentary front elevation illustrating the mounting of the rain deflector in the door mechanism.

In the illustrative embodiment of the invention as disclosed in the drawing, a vehicle cab generally designated 10, is provided with a body portion 11 defining a door opening 12 selectively closed by a door 13. The door may be swingably mounted to the body portion 11 by suitable means, such as hinge 14. A suitable door latch mechanism generally designated 15 is provided for controlling the securing of the door in the closed disposition, such as shown in FIG. 1. As illustrated fragmentarily in FIG. 2, a formed sheet metal frame 16 may be provided on the body portion 11 defining the opening 12 and extending substantially fully about the opening except at the area of the latch mechanism 15. As shown in FIG. 2, the frame is conventionally interrupted at the latch mechanism area and, thus, defines a breach in the frame through which rain water and the like may pass into the vehicle body.

The present invention is concerned with means for effectively preventing such undesirable passage of rain water and the like through the opening in the frame 16 at the latch mechanism area and, more specifically, comprehends an improved, readily installed low cost rain deflector adapted to be fitted to the door body at the latch mechanism area to effectively preclude such undesirable passage.

More specifically, as shown in FIGS. 3–8, the improved rain deflector generally designated 17 comprises a one-piece element which is adapted to be readily installed in the space 18 between the spaced end portions 19 and 20 of the frame 16 so as to close the space against inward movement of rain water and the like.

As shown in FIG. 2, body portion 11 defines a support generally designated 21 at space 18 including a base wall 22. A strike 37 is fixed to the base wall to provide means for latched association with the portions of the latch mechanism 15 carried by the door 13. As shown in FIG. 2, the strike includes a circular base portion 38 overlying the base wall 22. Such latch mechanisms are well known in the art and require no further description herein.

As further seen in FIG. 2, the frame end portions 19 and 20 effectively define openings 23 and 24 which open in opposed relationship toward space 18.

Referring now more specifically to FIGS. 6 through 9, rain deflector 17 may be seen to include a base wall portion 25, a top wall portion 26, a bottom wall portion 27, and a rear, or inner, transverse barrier wall portion 28. The distal end of the barrier wall 28 may be turned to define a forwardly extending flange 29.

The upper surface 30 of the bottom wall 27 is inclined downwardly to define a drain surface.

Base wall portion 25 may be provided with screw receiving openings 35 and 36, and a circular opening generally designated 34 for receiving the strike portion 38.

As indicated briefly above, the rain deflector 17 may comprise a one-piece element, and in the illustrated embodiment, is formed as a one-piece molded synthetic resin element. The element may advantageously be formed, for example, of polypropylene.

Figure 4:
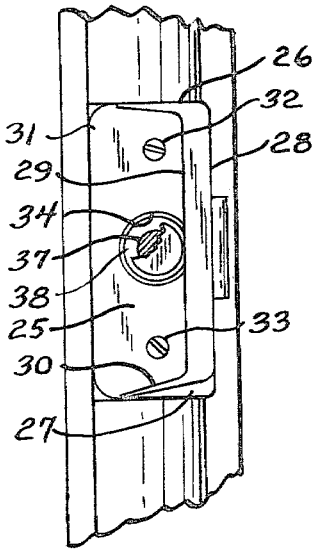
FIG. 4 is a fragmentary side elevation thereof.
Figure 5:
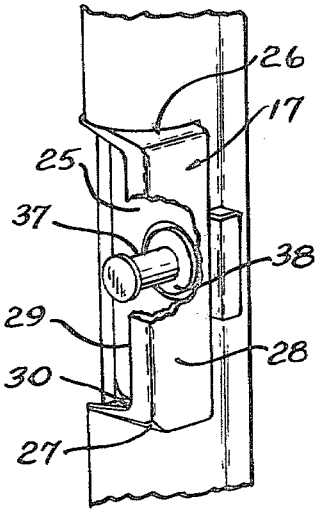
FIG. 5 is a fragmentary rear perspective view similar to that of FIG. 2 but with the rain deflector installed and partially broken away to facilitate illustration of the invention.
Figure 6:
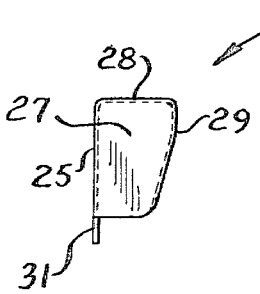
FIG. 6 is a top plan view of the rain deflector.
Figure 7:
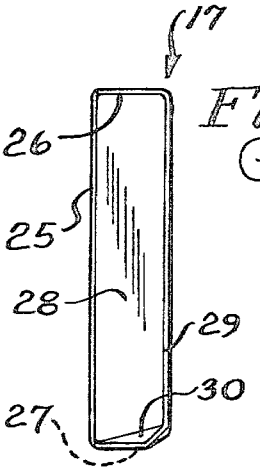
FIG. 7 is a front elevation thereof.
Figure 8:
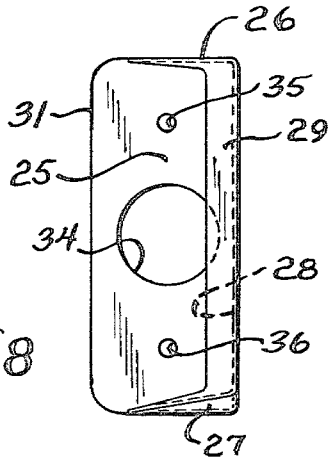
FIG. 8 is a side elevation thereof.
Figure 9:
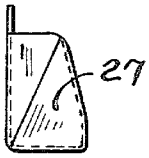
FIG. 9 is a bottom plan view thereof.

The installation of the rain deflector 17 in space 18 is extremely simple. More specifically, the rain deflector is positioned in the space 18 and secured in place by suitable threaded devices such as self-tapping metal screws 32 and 33 passed through openings 35 and 36 and self-threaded into openings 39 in the base wall 22. As shown, the rain deflector base wall portion 25 is disposed in facial engagement with base wall 22. As shown in FIG. 4, the diameter of opening 34 is slightly larger than the diameter of the strike portion 38 received therein so as to provide a secondary retention of the rain deflector in space 18 by the cooperation of this fit with the retaining association of the screws 32 and 33.

The mounting of the rain deflector in space 18 and removal thereof from the space when desired may be readily effected, while yet the rain deflector is effectively positively retained in the space 18 in normal usage of the vehicle door.

Rain water and the like intercepted by the inner barrier wall 28 during use of the vehicle is caused to be collected on the inclined surface 30 of the bottom wall 27 and is directed thereby forwardly from the deflector.

As shown, the front edge 31 of base wall 25 extends forwardly from the forward end of the top wall 26 and bottom wall 27.

INDUSTRIAL APPLICABILITY

The rain deflector of the present invention is adapted for use in a wide range of door mechanism applications wherein it is desirable to seal the space between the door and body frame adjacent the latch mechanism. The invention has been disclosed in conjunction with a vehicle cab door assembly, such as used in tractors and the like wherein the vehicle body defines a cab portion of the vehicle. As will be obvious to those skilled in the art, the invention is adaptable for use in any form of door structure where the door is exposed to impinging liquids, and other airborne material, such as rain water and the like.

The invention further is adapted for use with existing door latch mechanisms wherein the socket means 23,24 are conventionally present in the form of discontinuities in the frame at the door latch mechanism. As indicated above, the rain deflector configuration provides facilitated installation and removal when desired.

The use of the rain deflector provides substantially improved conditions within the operator's space of the vehicle not only providing improved comfort but also safety in minimizing fogging and the like as may result from passage of rain water, dust, and the like into the cab in normal use.

Other aspects, objects and advantages of this invention can be obtained from a study of the drawings, the disclosure and the appended claims. The foregoing disclosure of specific embodiments is illustrative of the broad inventive concepts comprehended by the invention.

We claim:

1. In a door latch mechanism (15) having a support (21) defining a base wall (22), a strike (37) projecting from said base wall and having an enlarged base portion (38) at said base wall, the improvement comprising:

a rain deflector (17) having a base wall portion (25) adapted to mount in facially overlying relationship to said support base wall (22), an inner transverse barrier wall portion (28) for intercepting rain water and the like passing inwardly past said strike, said base wall portion having an opening (34) fitting said enlarged base portion (38); and means (32,33) for securing said base wall portion (25) to said base wall (22) to cooperate with said enlarged base portion in retaining said deflector mounted to said support.

2. The door latch mechanism of claim 1 wherein said base wall portion (28) defines a circular opening (34).

3. The door latch mechanism of claim 1 wherein said deflector (17) defines a sloping bottom wall surface (30) for directing rain water forwardly therefrom.

4. The door latch mechanism of claim 1 wherein said deflector further defines a turned flange (29) on the distal edge of the barrier wall (28) extendiing substantially parallel to said base wall (25).

5. The door latch mechanism of claim 1 wherein said rain deflector (17) comprises a one-piece element.

6. In a door latch mechanism (15) having a support (21) defining a base wall (22), and a strike (37) projecting from said base wall, the improvement comprising:

a one-piece rain deflector element (17) having a base wall portion (25) adapted to mount in facially overlying relationship to said support base (22), an inner transverse barrier wall portion (28) for intercepting rain water and the like passing inwardly past said strike, and interlock means (32,33,34,38) for securing said deflector removably to said support (21).

7. The door latch mechanism of claim 6 wherein said deflector element (17) is formed of a flexible material.

8. The door latch mechanism of claim 6 wherein said deflector element (17) is formed of a molded synthetic resin.

9. The door latch mechanism of claim 6 wherein said deflector element further defines a drain surface 30 for draining rain water and the like intercepted by said barrier wall (28).

10. The door latch mechanism of claim 6 wherein said interlock means includes an opening (34) in said deflector element and a shoulder element (38) on said support closely fitting said opening to prevent lateral displacement of said deflector element.

11. The door latch mechanism of claim 6 wherein said interlock means includes an opening (34) in said deflector element and a shoulder element (38) on said support closely fitting said opening to prevent lateral displacement of said deflector element, and means (32,33) removably securing said deflector element to said support for maintaining the fitted relationship between said shoulder element and deflector element.

* * * * *